United States Patent [19]

Jones

[11] Patent Number: 4,711,409

[45] **Date of Patent: * Dec. 8, 1987**

[54] PAWL CONTROLLED REEL EXTENSION

[76] Inventor: Ralph W. Jones, 1025 Avondale Rd., San Marino, Calif. 91108

[ * ] Notice: The portion of the term of this patent subsequent to Jan. 27, 2004 has been disclaimed.

[21] Appl. No.: 931,522

[22] Filed: Nov. 17, 1986

Related U.S. Application Data

[63] Continuation-in-part of Ser. No. 766,537, Aug. 19, 1985, Pat. No. 4,638,959.

[51] Int. Cl.[4] ..... B65H 75/48

[52] U.S. Cl. ..... 242/107.4 R

[58] Field of Search ..... 242/107.4 R, 107.5, 242/99, 57, 37 R, 49, 54 R, 96; 116/67 A; 254/271

[56] References Cited

U.S. PATENT DOCUMENTS

| | | | |
|---|---|---|---|
| 2,078,489 | 4/1937 | Forss | 242/107.4 R |
| 3,036,629 | 5/1962 | Nicholas | 242/107.4 R X |
| 3,411,730 | 11/1968 | Kelley | 242/57 X |
| 4,142,692 | 3/1979 | Andres | 242/107.4 R X |
| 4,220,293 | 9/1980 | Gename | 242/9.6 X |
| 4,638,959 | 1/1987 | Jones | 242/107.4 R |

*Primary Examiner*—John M. Jillions

*Attorney, Agent, or Firm*—William W. Haefliger

[57] ABSTRACT

A line dispensing and retracting device comprising (a) a reel having a hub about which the line is wound as the reel rotates, (b) structure mounting the reel for rotation relative thereto, and about an axis, (c) a generally radially movable element carried by the reel to move between an inwardly retracted position in which the reel is free to rotate, and an outwardly extended position in which the movable element prevents further dispensing of the line, (d) and the line wound on the reel in operative relation with the movable element to control said element's movement in response to reel rotation, (e) the line including an inner winding located to urge said element outwardly relative to the reel in response to reel rotation in a line dispensing direction, and also to prevent outward movement of said element until a portion of said inner winding proximate said element moves relatively away from the reel.

21 Claims, 12 Drawing Figures

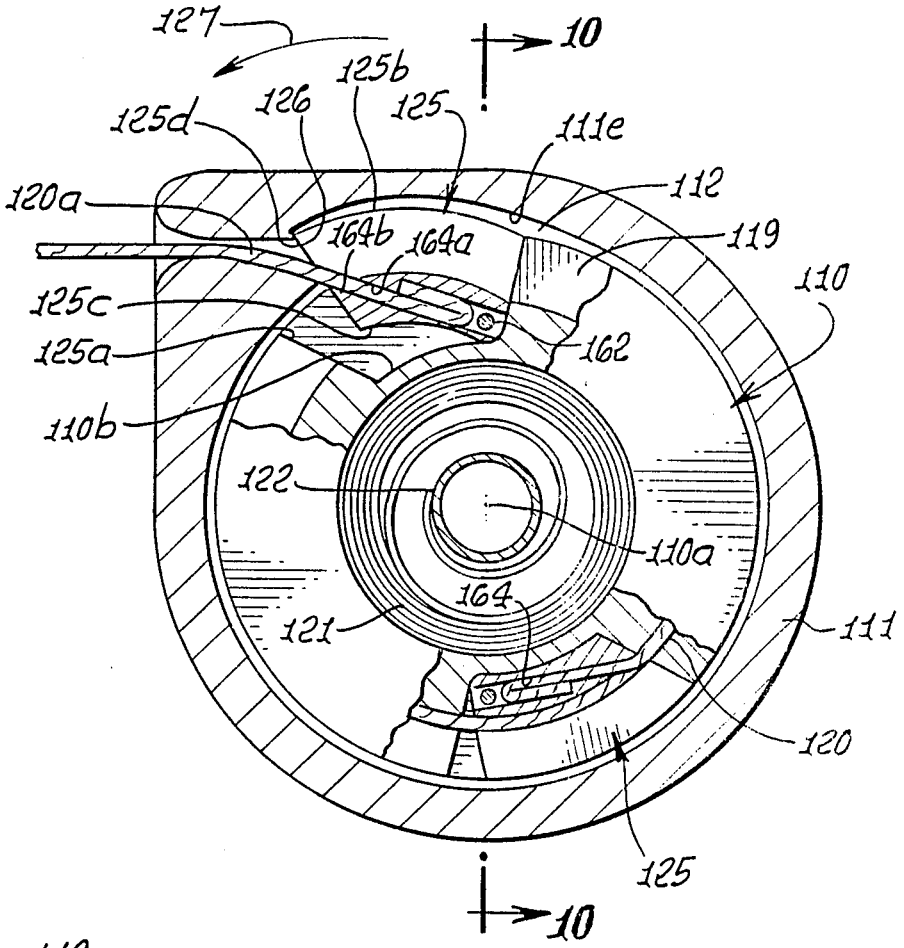
FIG. 9.
FIG. 10.
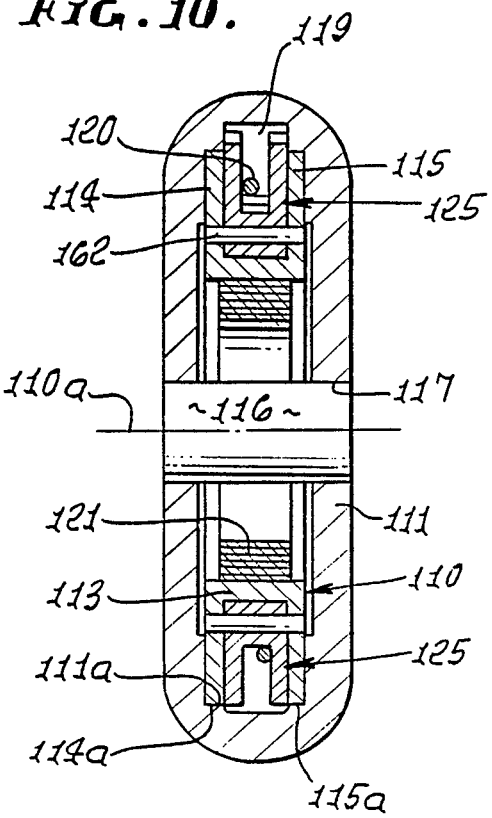
FIG. 11.
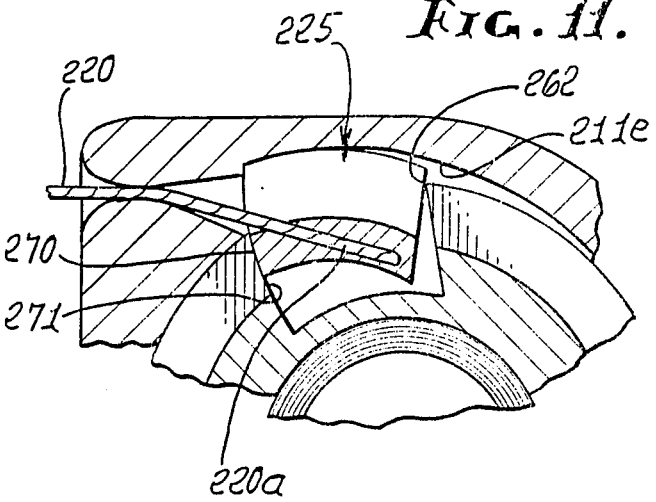

PAWL CONTROLLED REEL EXTENSION

This application is a continuation-in-part of Ser. No. 766,537, filed Aug. 19, 1985 now U.S. Pat. No. 4,638,959.

BACKGROUND OF THE INVENTION

This invention relates generally to reels for lines such as cable or cord, and more particularly concerns a line dispensing and retracting reel in which the amount of dispensing of line is controlled by structure associated with reeling and unreeling of the line.

In spring-operated, self-retracting reels, eventual failure through repeated use will sometimes occur when the reel is fully extended. If the reel is designed so that its outward extension is limited by the retracting spring becoming solidly wound ("bottoming out"), failure is likely to occur at the outer-end anchor point of the spring. If the reel is designed so that its outward extension is limited by the retractable element (cord, tape, chain, etc.) unwinding to its end, failure is likely to occur at the inner-end anchor point of the retractable element.

Both types of failure occur because the normally tangential anchorage of the spring or the retractable element is subjected to almost radial forces. If such radial forces can be avoided, the described types of failure are less likely to occur.

SUMMARY OF THE INVENTION

It is a major purpose of my invention to provide an improved type of spring-operated, self-retracting reel in which the outward extension of the reel is stopped in a positive manner before either the spring or the retractable element reaches its limit, thus precluding the possibility of radial forces that might destroy the normally tangential anchorage of the spring or retractable element.

It is another purpose of my invention to provide mechanism by which the outward extension of a reel is positively stopped. Positive stopping is achieved by outward movement of a pawl (or similar member) which rotates with the reel and engages the reel housing or mount or otherwise acts to prevent further extension of the reel. The outward movement of the pawl is caused by the unwrapping of an inner wrap of the retractable element, forcing the pawl outwardly. Further objects include the control of pawl outward movement; and the containment of the rotating reel within a rotary bearing surface. Rewinding of the retractable element not only allows the pawl to retract, but forces it to do so.

Accordingly, the line dispensing and retracting invention includes:

(a) a reel having a hub about which the line is wound as the reel rotates, (b) structure mounting the reel for rotation relative thereto, and about an axis, (c) a movable element carried by the reel to move between an inwardly retracted position in which the reel is free to rotate, and an outwardly extended position in which the movable element prevents further dispensing of the line, (d) the line wound on the reel in operative relation with the movable element to control said element's movement in response to reel rotation, (e) the line including an inner winding located to urge said element outwardly relative to the reel in response to reel rotation in a line dispensing direction, and also to prevent outward movement of said element until a portion of said inner winding proximate said element moves relatively away from the reel.

Further, and in one example, the line typically includes an inner winding extending sufficiently beneath the element in the form of a stop pawl as to urge the pawl outwardly relative to the reel in response to reel rotation in one direction; and the line also typically includes at least one outer winding on the reel acting to urge the pawl inwardly relative to the reel in response to reel rotation in the opposite direction.

In addition, the pawl typically has an inwardly facing surface engaged by said inner winding, and an outwardly facing surface engaged by said outer winding; and the mounting structure may advantageously include a pawl guide surface extending spirally at least partially about said axis, and toward the stop shoulder. The line typically includes at least one outer winding on the reel acting to urge the pawl inwardly relative to the reel in response to reel rotation in a line retracting direction.

The pawl and its functions on the reel avoid problems inherent in the following prior art methods for limiting extension of the retractable element of a dispensing/retracting reel:

1. Permitting either a spring or the retractable element to "bottom out" as described earlier, with the inherent probability of failure at the anchorage of the spring or the retractable element;

2. Providing an enlargement near the inner end of the retractable element, too large to pass through an exit opening. Such an enlargement interferes with or complicates the smooth reeling of the retractable element;

3. Limiting the number of turns through which the reel is permitted to rotate as it dispenses the retractable element. This limitation has typically been achieved by a helical movement of the reel bringing it into contact with a stop, by a "Geneva Wheel" stop mechanism, by gearing or by similar mechanical approaches, all of which have the disadvantage of mechanical complication and space requirements.

The present invention avoids the problems inherent in any of the foregoing three methods by the use of one movable part that is simple and reliable in its action. It protects the retractable element or its retracting spring from "bottoming out". It does not interfere with the smooth reeling of the retractable element, and it does not complicate reel construction or add to space requirements.

These and other objects and advantages of the invention, as well as the details of an illustrative embodiment will be more fully understood from the following specification and drawings, in which:

DRAWING DESCRIPTION

FIG. 9 is a view like FIG. 3, showing a modification;

FIG. 10 is a section on lines 10—10 of FIG. 9; and

FIG. 11 is a fragmentary view like an upper portion of FIG. 9, showing a further modification.

DETAILED DESCRIPTION

Figure 1:
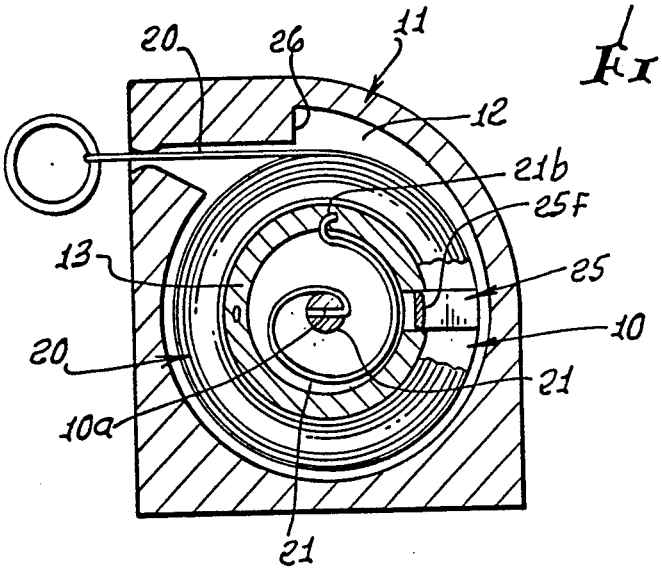
FIG. 1 is an elevation, taken in section, and showing a reel incorporating the invention, and the pawl is retracted condition.

In the drawings, a reel 10 is carried for rotation about a reel axis 10a, as by case structure 11 forming an interior hollow 12 in which the reel rotates. Merely by way of one example, the reel 10 may include a hub 13, two axially spaced flanges 14 and 15, and trunnions 16 received in bearings 17 formed by the case structure (see FIG. 8). Other reel and case structures may be provided. The space 19 between the flanges is adapted to receive a wound line 20, such as a cord, cable, or other form, and the reel may be self-retracting, as provided by a coil spring 21. One end 21a of the latter may be attached to a fastener 22, or other device attached to the case and extending into the hub hollow 23: and the other end 21b of the coil spring may be attached to the reel.

Figure 2:
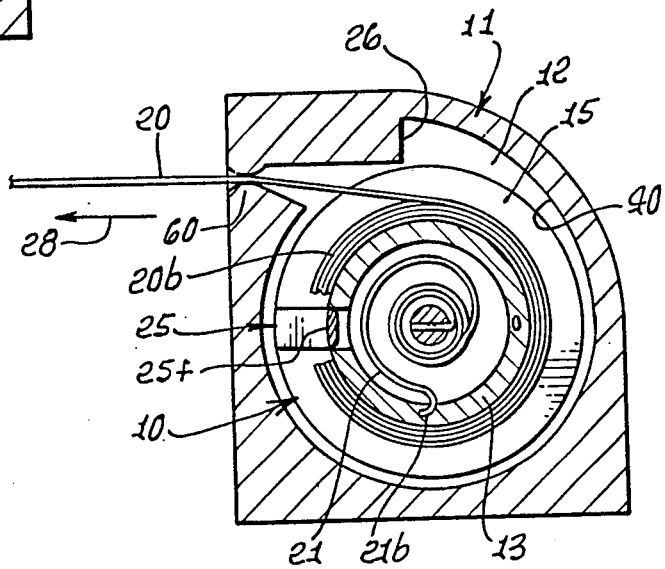
FIG. 2 is a view like FIG. 1, showing the line partially extended.
Figure 3:
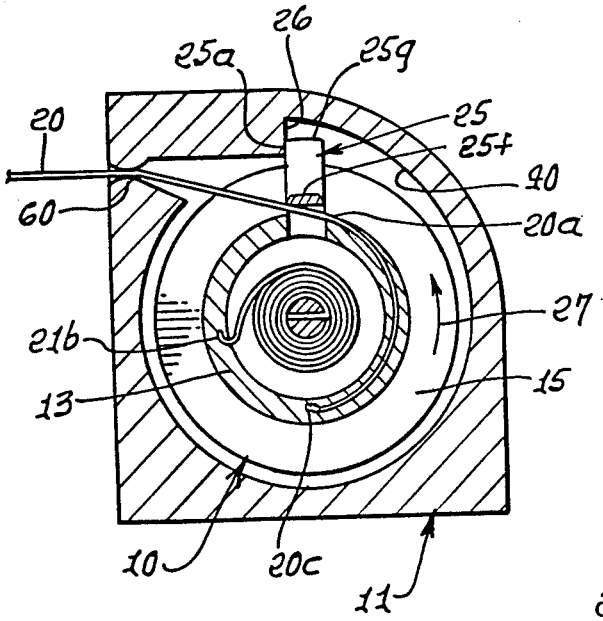
FIG. 3 is a view like FIGS. 1 and 2, but with the pawl extended in reel rotation blocking position.
Figure 4:
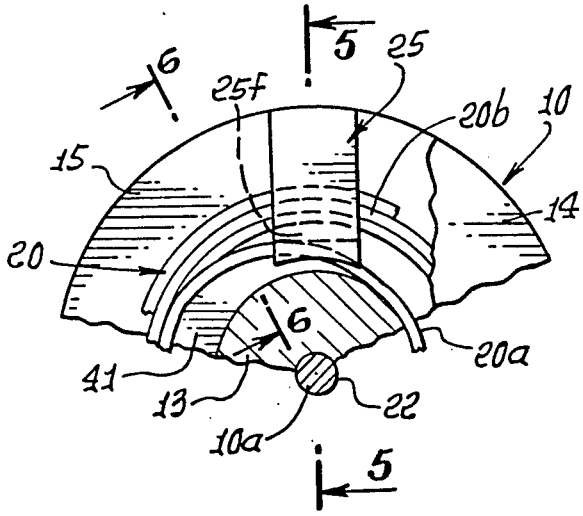
FIG. 4 is a fragmentary side elevation showing the pawl in retracted position on the reel, with line windings below and above a section of the pawl.

In accordance with the invention, a stop pawl, as for example at 25, is carried by the reel to move between an inwardly retracted position (FIGS. 1, 2, 4 and 5) in which the reel is free to rotate; and an outwardly extended position (FIGS. 3 and 8) in which the stop pawl is engageable with a stop shoulder, as for example at 26, on the case structure, thereby to block further reel rotation in at least one rotary direction (see rotary direction indicated by arrow 27, in FIG. 3). Further, the line 20 is wound on the reel in operative relation with the pawl to control its movement between said retracted and extended positions, in response to reel rotation.

For example, line extension in direction 28 may be interrupted by pawl movement to FIG. 3 extended position, as controlled by the line, and self-retraction of the reel as it rotates in the opposite direction may serve not only to wind the line on the hub, but also to retract the pawl, as will appear. FIGS. 1–3 also show a line guide opening 60 in the casing 11, the line in pawl extended position extending linearly between said opening and the hub, and directly beneath the inner extent of the pawl.

Figure 6:
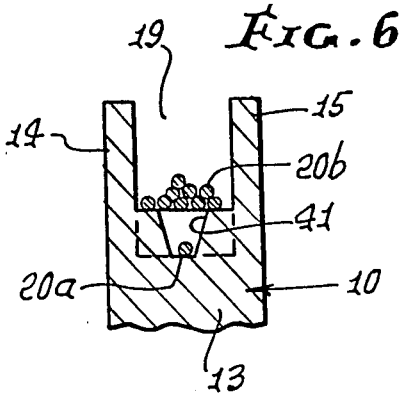
FIG. 6 is a section on lines 6—6 of FIG. 4.
Figure 6A:
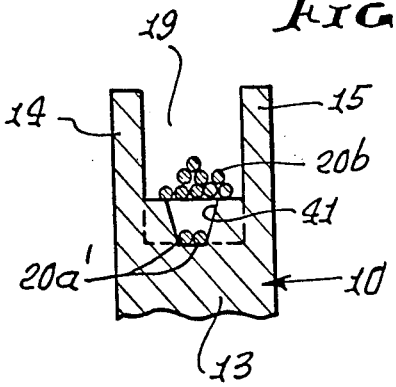
FIG. 6a is a view like FIG. 6, showing a modification.
Figure 7:
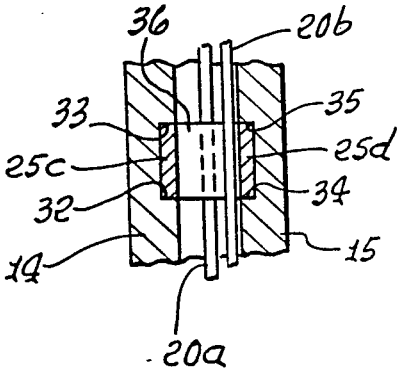
FIG. 7 is a section on lines 7—7 of FIG. 5.
Figure 8:
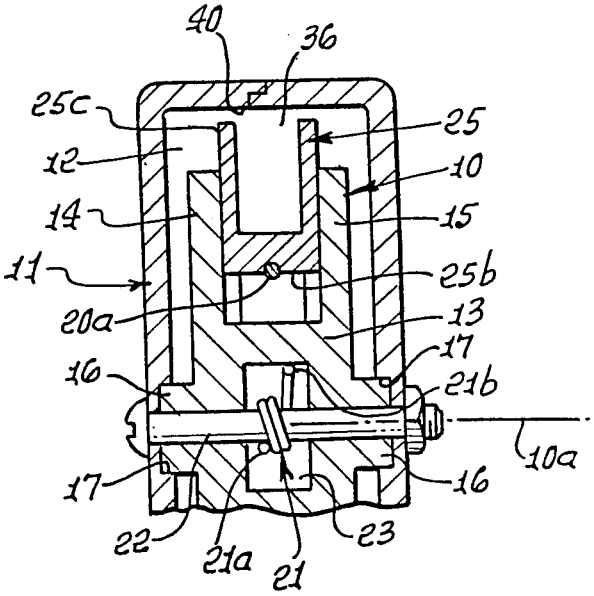
FIG. 8 is a view like FIG. 5, but showing the pawl extended radially.

More specifically, the line 20 may typically include an inner winding 20a (or multiple inner windings 20a; as will appear in FIG. 6a) extending sufficiently beneath the pawl as to urge the pawl outwardly relative to the reel in response to its rotation in direction 27. See for example FIGS. 3 and 8 wherein the inner winding 20a has lifted the pawl outwardly, due to tension T in unwound and distended line 20, the pawl outer extent 25a engaging stop shoulder 26 on case 11. Lifting force is exerted on inward facing surface 25b of the pawl, which may be grooved as seen in FIG. 8 to center the winding 20a. The pawl itself may be guided for inward and outward radial movement by guide shoulders 32–35 on the reel flanges, as seen in FIG. 7. The pawl may have rectangular, cylindrical, or other cross section, as viewed endwise in FIG. 7; and it is configured to accept inwardly and outwardly spaced line wrappings on the reel. The end of the line is anchored to the reel as at 20c, in FIG. 3.

Figure 5:
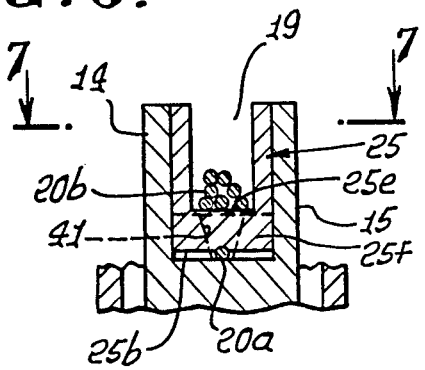
FIG. 5 is a section on lines 5—5 of FIG. 4.

The space 36 between the pawl arms 25c, and 25d receiving outer windings 20b of line 20, is indicated for example in FIG. 5. Such outer windings also extend about the reel hub, and they act to urge the pawl inwardly relative to the reel, as indicated in FIG. 5. They exert inward directed force against outward facing surface 25e on the pawl cross-piece 25f.

The mounting structure for the reel, i.e. the case for example, may advantageously include a pawl guide surface 40 facing inwardly and extending spirally at least partly about axis 10a, and toward stop shoulder 26, to progressively guide the pawl outermost surfaces 25g toward shoulder 26 as the pawl is progressively lifted by line winding 20a, and toward FIGS. 3 and 8 position. Upon retraction of the reel, the inner winding 20a is pulled back toward its position seen in FIGS. 5–7, and the outer windings 20b are formed on the pawl in space 36, and on the reel hub, to urge the pawl toward retracted position. The reel hub may be grooved as shown at 41, to receive the retracting winding 20a. See FIG. 6.

As stated, the pawl can take any of a number of different shapes so long as it satisfies the following conditions:

1. When the pawl is extended, it positively engages a fixed stop, or otherwise prevents further rotation of the reel in one direction and when it is retracted, it does not prevent reel rotation.

2. The pawl is unable to extend as long as cord is wrapped over it.

3. The pawl is forced to extend and engage when cord wrapped beneath it (typically, but not necessarily the last wrap) starts to lift off of the reel.

The modified device of FIGS. 9 and 10 includes a reel 110 carried for rotation about reel axis 110a, as by case structure 11 forming an interior hollow 112 in which the reel rotates. The reel includes a hub 113 and two axially spaced flanges 114 and 115. A centrally fixed post 116 is attached to case structure. Space 119 between the flanges receives wound line 120, and the reel may be self-retracting, as by a coil spring 121. One end of the spring is attached at 122 at the fixed post; and the opposite end of the (flat) coiled spring is suitably attached to the reel. The reel is slidably confined to rotate by a journal bearing surface or surfaces 111a defined by the case 111, the outer surfaces 114a and 115a of the flanges 114 and 115 being engageable with surface 111a. Surface or surfaces 111a extend circularly at least 300° about the axis 110a.

A stop pawl 125 is carried to move between an inwardly retracted position in pocket 125a in the reel when the reel is free to rotate; and an outwardly extended position (see full lines in FIG. 9) in which the stop pawl is engageable with a stop shoulder, as at 126 on the case structure, thereby blocking further reel rotation in at least one rotary direction (the rotating direction indicated by arrow 127). Further, the line is wound on the reel to control its movement between retracted and extended positions, in response to reel rotation. Note pivoting of the pawl to the reel at 162; the generally trapezoidal shape of the pawl, at its opposite sides; the convex outer surface 125b of the pawl to fit the curvature of journal surfaces 111a; and the concave inner surface 125c of the pawl to fit against the reel surface 110b at the inner side of the pocket 125a. The forward surface 125*d* of the pawl is angled radially relative to axis 110*a*, as is stop shoulder 126, for maximum stoppage.

Line 120 includes an inner winding extending in an opening 164 through the pawl that defines an inward facing surface 164*a* engaged by the line inner winding 120*a*, and an outwardly facing surface 164*b* engaged by the winding 120*a*. As the line unwinds, the winding 120*a* ultimately urges the pawl to pivot outwardly relative to the reel, as seen in FIG. 9, to engage stop shoulder 126 to block reel rotation; and the winding 120*a* also prevents outward movement of the pawl (by engaging surface 164*b*) until that portion of the inner winding proximate or nearest the pawl moves relatively away from the pawl. This prevents uncontrolled pawl movement outwardly under centrifugal force as the last line wrap holding it in leaves the reel, a condition that could stop the unreeling of the line one revolution earlier than intended.

In FIG. 11 the construction is similar, excepting that the pawl 225 is not pivotally connected to rhe reel, but free to float relative thereto about pivot point 262 under the control of inner winding 220*a* of line 220. Pivot point 262 is formed by a reel outer shoulder, as shown.

The pawl also has a forwardly convex shoulder 270 that guides against concave reel shoulder 271 as the pawl pivots outwardly under the control of the winding 220*a*.

Note also, in FIGS. 9 and 11, the pawl guide surfaces 111*e* and 211*e* defined by the core and spiraling about the axis and toward the stop shoulder to allow pawl outward movement but also to confine such outward movement.

Confinement of the reel to rotate within journal bearing surfaces 111*a* adds greatly to simplicity of construction and ease of assembly.

I claim:

1. In line dispensing and retracting device, comprising:

(a) reel having a hub about which the line is wound as the reel rotates, (b) structure mounting the reel for rotation relative thereto, and about an axis, (c) a generally radially movable element carried by the reel to move between an inwardly retracted position in which the reel is free to rotate, and an outwardly extended position in which the movable element prevents further dispensing of the line, (d) and the line wound on the reel in operative relation with the movable element to control said element's movement in response to reel rotation, (e) said line including an inner winding extending sufficiently beneath said element as to urge the element outwardly relative to the reel in response to reel rotation in a line dispensing direction, (f) and said line passing through said element.

2. A line dispensing and retracting device, comprising (a) a reel having a hub about which the line is wound as the reel rotates, (b) structure mounting the reel for rotation relative thereto, and about an axis, (c) a stop pawl carried by the reel to move between an inwardly retracted postion in which the reel is free to rotate, and an outwardly extended position in which the pawl is engageable with a stop shoulder on said structure to block reel rotation in one rotary direction, and (d) the line wound on the reel in operative relation with the pawl to control said pawl movement in response to reel rotation, (e) said line including an inner winding extending sufficiently beneath the pawl as to urge the pawl outwardly relative to the reel in response to reel rotation in a line dispensing direction, (f) and means surrounding the reel and acting to journal its rotation.

3. The device of claim 2 including said line passing through the pawl to block pawl outward movement until the pawl is urged outwardly.

4. The device of claim 2 wherein the line includes at least one outer winding on the reel acting to urge the pawl inwardly relative to the reel in response to reel rotation in a line retracting direction.

5. The device of claim 4 wherein the pawl has an inwardly facing surface engaged by said inner winding, and an outwardly facing surface engaged by said outer winding.

6. The device of claim 2 wherein said mounting structure includes a pawl guide surface extending spirally at least partially about said axis, and toward the stop shoulder.

7. The device of claim 2 wherein the reel includes spring means providing for self-retracting movement of the reel.

8. The device of claim 2 wherein the reel has axially spaced flanges between which the line winds on the hub, said flanges forming generally radially extending guide shoulders to guide the pawl generally radially relative to the reel, the pawl having two axially spaced shoulders engaging said guide surfaces.

9. The device of claim 8 wherein the pawl in said extended position projects outwardly of the reel periphery to engage the stop shoulder.

10. A line dispensing and retracting device, comprising:

(a) a reel having a hub about which the line is wound as the reel rotates, (b) structure mounting the reel for rotation relative thereto, and about an axis, (c) a stop pawl carried by the reel to move between an inwardly retracted position in which the reel is free to rotate, and an outwardly extended position in which the pawl is engageable with a stop shoulder on said structure to block reel rotation in one rotary direction, and (d) the line wound on the reel in operative relation with the pawl to control said pawl movement in response to reel rotation, (e) the pawl being configured to accept inwardly and outwardly spaced line wrappings on the reel, (f) the line passing through the pawl.

11. A line dispensing and retracting device, comprising, (a) a reel having a hub about which the line is wound as the reel rotates, (b) structure mounting the reel for rotation relative thereto, and about an axis, (c) a generally radially movable element carried by the reel to move between an inwardly retracted position in which the reel is free to rotate, and an outwardly extended position in which the movable element prevents further dispensing of the line, (d) and the line wound on the reel in operative relation with the movable element to control said element's movement in response to reel rotation, (e) said line including an inner winding located to urge said element outwardly relative to the reel in response to reel rotation in a line dispensing direction, and also to prevent outward movement of said element until a portion of said inner winding proximate said element moves relatively away from the reel.

12. The device of claim 11 wherein said structure mounting the reel for rotation includes a case extending about the reel and providing a journal bearing surface engageable by the major peripheral surfaces on the reel.

13. A line dispensing and retracting device, comprising (a) a reel having a hub about which the line is wound as the reel rotates, (b) structure mounting the reel for rotation relative thereto, and about an axis, (c) a stop pawl carried by the reel to move between an inwardly retracted position in which the reel is free to rotate, and an outwardly extended position in which the pawl is engageable with a stop shoulder on said structure to block reel rotation in one rotary direction, and (d) the line wound on the reel in operative relation with the pawl to control said pawl movement in response to reel rotation, (e) said line including an inner winding located to urge said pawl outwardly relative to the reel in response to reel rotation in a line dispensing direction, and also to prevent outward movement of said pawl until a portion of said inner winding proximate said pawl moves relatively away from the reel.

14. The device of claim 13 wherein said structure mounting the reel for rotation includes a case extending about the reel and providing a journal bearing surface engageable by a peripheral surface on the reel.

15. The device of claim 13 wherein the line includes at least one outer winding on the reel acting to urge the pawl inwardly relative to the reel in response to reel rotation in a line retracting direction.

16. The device of claim 15 wherein the pawl has an inwardly facing surface engaged by said inner winding, and an outwardly facing surface engaged by said outer winding.

17. The device of claim 13 wherein said mounting structure includes a pawl guide surface extending spirally at least partially about said axis, and toward the stop shoulder.

18. The device of claim 13 in which the pawl is configured to accept inwardly and outwardly spaced line wrappings on the reel.

19. The device of claim 13 wherein the reel includes spring means providing for self-retracting movement of the reel.

20. The device of claim 13 wherein the reel has axially spaced flanges between which the line winds on the hub, said flanges forming generally radially extending guide shoulders to guide the pawl to pivot relative to the reel, the pawl having two axially spaced shoulders engaging said guide surface, there being an axis of pawl pivoting, on the reel.

21. The device of claim 20 wherein the pawl in said extended position projects outwardly of the reel periphery to engage the stop shoulder.

* * * * *